US010419854B2

(12) United States Patent
Telle

(10) Patent No.: US 10,419,854 B2
(45) Date of Patent: Sep. 17, 2019

(54) SPEAKER ASSEMBLY

(71) Applicant: Jose Luis Telle, Miami, FL (US)

(72) Inventor: Jose Luis Telle, Miami, FL (US)

( * ) Notice: Subject to any disclaimer, the term of this patent is extended or adjusted under 35 U.S.C. 154(b) by 0 days.

(21) Appl. No.: 15/727,996

(22) Filed: Oct. 9, 2017

(65) Prior Publication Data

US 2019/0230440 A1 Jul. 25, 2019

(51) Int. Cl.

| | |
|---|---|
| ***H04R 9/00*** | (2006.01) |
| ***H04R 7/18*** | (2006.01) |
| ***H04R 9/06*** | (2006.01) |
| ***H04R 7/12*** | (2006.01) |

(52) U.S. Cl.

CPC ..... *H04R 7/18* (2013.01); *H04R 7/127* (2013.01); *H04R 9/06* (2013.01)

(58) Field of Classification Search

CPC ..... H04R 9/00
USPC ..... 381/396, 398, 433
See application file for complete search history.

(56) References Cited

U.S. PATENT DOCUMENTS

| | | | | |
|---|---|---|---|---|
| 7,025,170 | B2 * | 4/2006 | Lin | H04R 9/06 181/171 |
| 7,480,391 | B2 * | 1/2009 | Kobayashi | H04R 7/20 381/398 |
| 8,126,185 | B1 * | 2/2012 | Dai | H04R 7/18 381/386 |
| 2009/0225018 | A1 * | 9/2009 | Kim | G09G 3/3659 345/90 |

* cited by examiner

*Primary Examiner* — Suhan Ni
(74) *Attorney, Agent, or Firm* — Sanchelima & Associates, P.A.; Jesus Sanchelima, Esq.; Christian Sanchelima, Esq.

(57) ABSTRACT

A speaker assembly with a readily replaceable cone that is mounted to a depression 24 within a peripheral channel 22. The cone 30 is kept in place with a ring 40 that coacts with the cone 30 at a peripheral step 35 located a predetermined distance from the cone's distal end 32*a*. Fastening members 50 keep the ring 40 secured to basket assembly 20 reducing the performance fatigue of cone 30.

3 Claims, 4 Drawing Sheets

SPEAKER ASSEMBLY

BACKGROUND OF THE INVENTION

1. Field of the Invention

The present invention relates to a speaker assembly and, more particularly, to such an assembly with a readily removable cone that minimizes the cone fatigue.

2. Description of the Related Art

For conventional speaker assemblies when the cone is mounted to the speaker basket using fastening means and adhesives. The speaker cones typically include radially and outwardly extending flanges that are mounted to compatible peripheral areas of the speaker baskets. The flange is mounted to the basket peripheral area, and an adhesive is typically used that requires time to dry. The coning operation requires letting the adhesive dry for several minutes or hours. This is an undesirable feature, specially in public events when cones with ruptures need to be replaced fast.

Additionally, the interface between the flange and the rest of the cone is susceptible to fatigue from the constant vibrations inherent in the operation of the cone. This eventually leads to ruptures of the flexible paper cones.

The present invention does not require the use of an adhesive and substantially eliminates the fatigue exposure of the cone. The present invention allows a manufacturer to facilitate the coning operation for its customers.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a speaker assembly to minimize the exposure to fatigue of the cone.

It is another object of this invention to provide a speaker assembly that does not require using adhesives to mount a cone to the speaker basket.

It is yet another object of this invention to provide such an assembly that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
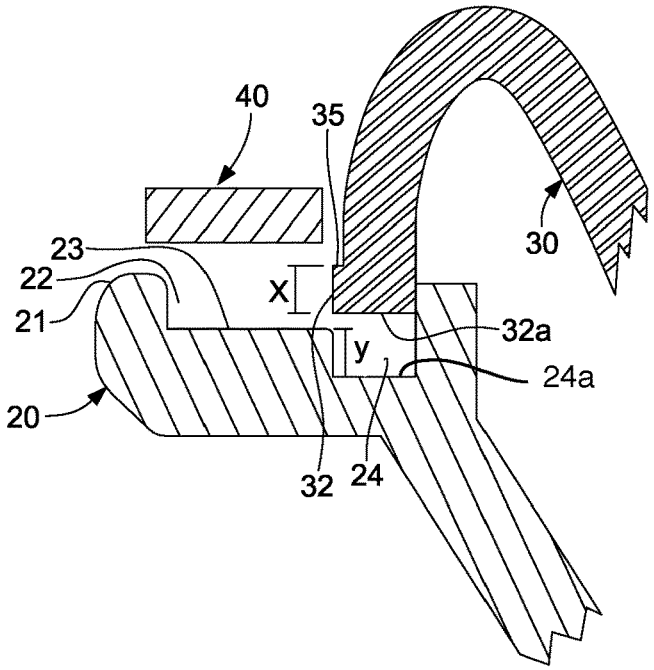
FIG. 1 represents a cross-section of a portion of a speaker basket assembly 20, cone 30 and ring 40 in the process of mounting cone 30 to speaker basket assembly 20.

Referring now to the drawings, where the present invention is generally referred to with numeral 10, it can be observed that it basically includes basket assembly 20, cone 30 and ring 40. These three components allow a user to readily change a cone 30 without using adhesives and with a physical structure that minimizes fatigue on cone 30.

Figure 2:
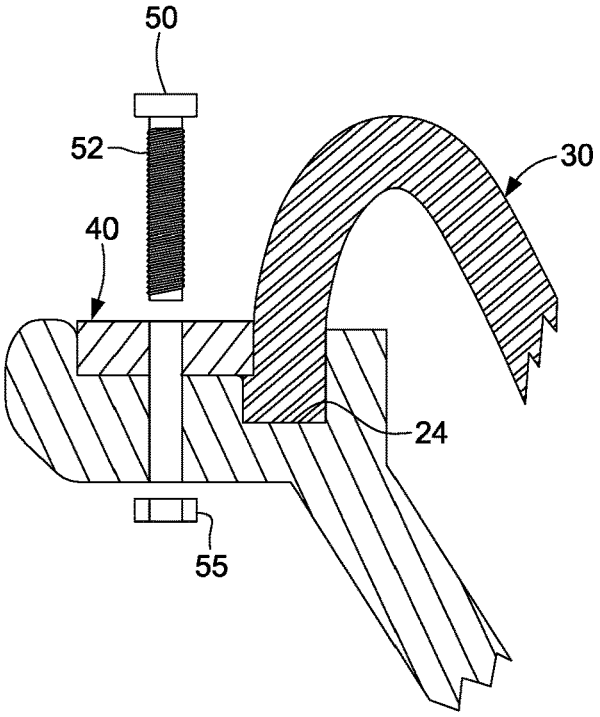
FIG. 2 shows a similar view to FIG. 1 with the components assembled.
Figure 3:
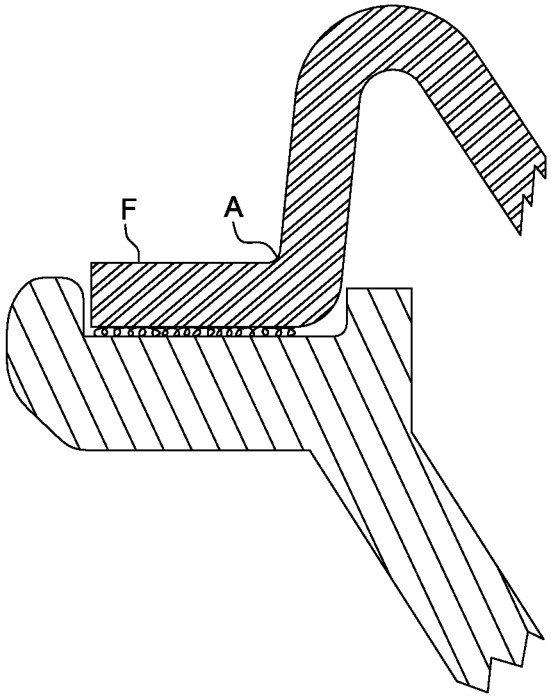
FIG. 3 (PRIOR ART)
FIG. 3 illustrates a similar view of the previous two figures with a typical prior art cone indicating with the letter "A" the area of fatigue in flange "F".
Figure 4:
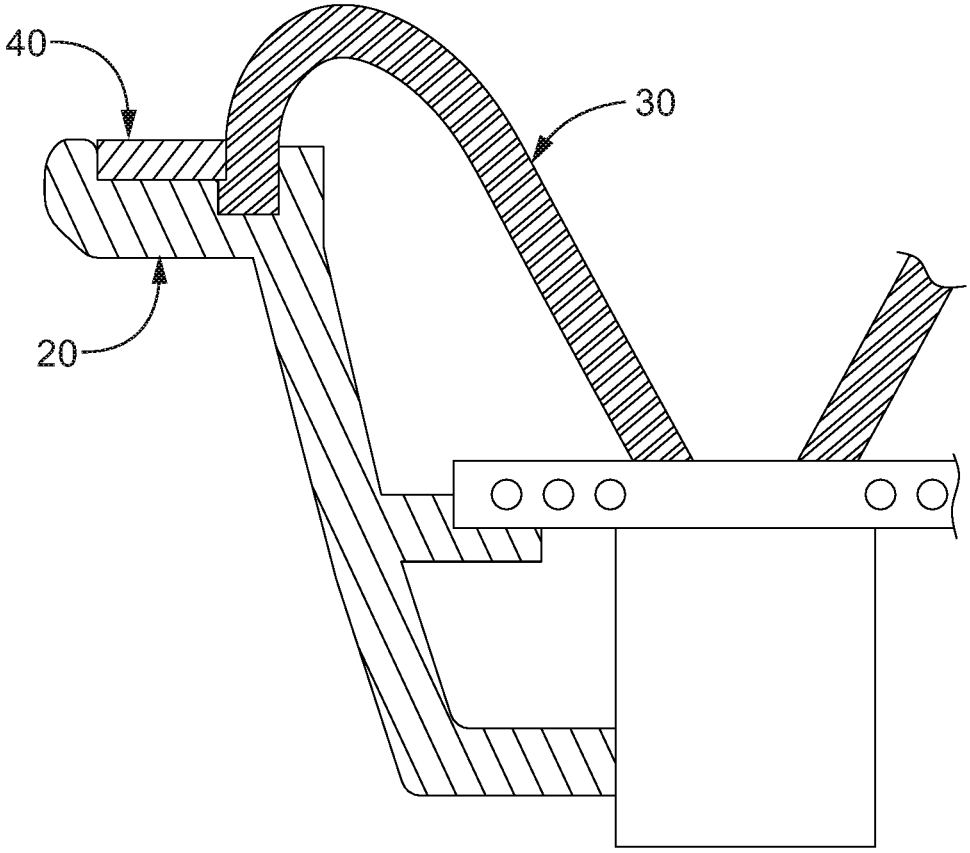
FIG. 4 is a cross section view of approximately half of the speaker assembly, in accordance with the present invention.
Figure 5:
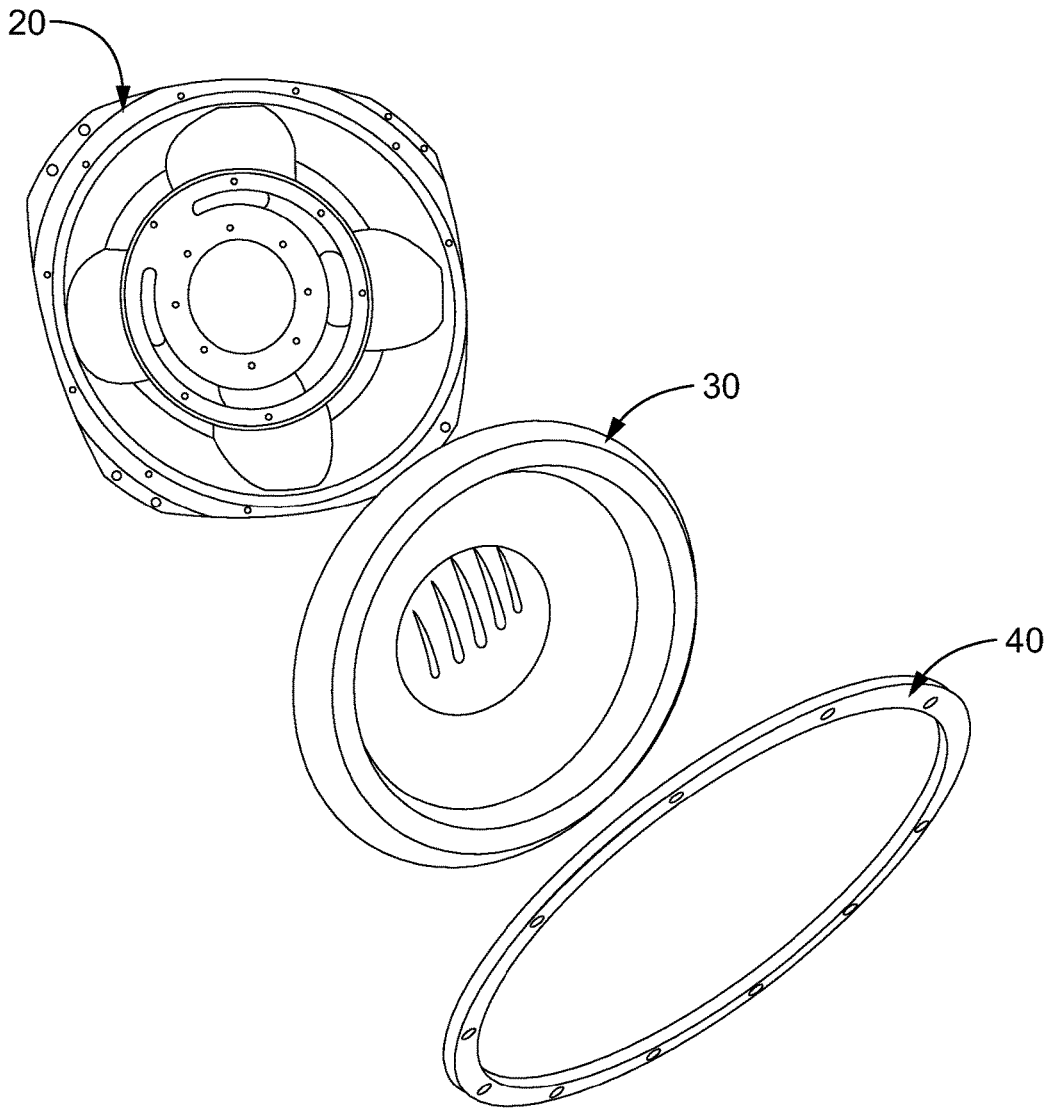
FIG. 5 is an exploded view of speaker assembly 10 showing the different components.

Basket assembly 20, as best seen in FIGS. 1 and 2, includes a peripheral channel 22 adjacent to peripheral end 21. Additionally, channel 22 includes a co-extending depression 24 located at the innermost end of channel 22. Cone 30 is made out of a flexible material, such as paper, and includes a cone peripheral edge 32 that is slightly thicker than depression 24. Edge 32 is snuggly fitted inside depression 24. The thickness of edge 32 is reduced at a location that is at distance "X" from distal end 32*a*, as indicated in FIG. 1. And depression 24 has a depth of "Y" that is slightly smaller than distance "X", in one of the preferred embodiments. Ring 40 has cooperative dimensions to fit mostly in this channel 22 except for depression 24. Ring 40 overextends slightly to come in an abutting relationship with channel bottom 23 and step 35 defined at an "X" distance from edge 32. Ring 40 is pressed against step 35 and depresses cone 30 slightly inwardly thereby keeping the latter secured in place, as seen in FIG. 2. The resulting structure does not have the prior art exposed flange F with fatigue area "A", is shown in FIG. 3. Moreover, the speaker assembly 10 allows a user to readily replace cone 30 without using any adhesives or special tools. Fastening components 50 include bolts 52 and nuts 55 that are used to keep ring 40 secured in place, as best seen in FIG. 2.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A speaker assembly, comprising:

A) a speaker basket assembly 20 having a peripheral channel 22 having a first bottom 23 extending along a first plane and a coextensive inner depression 24 having a second bottom 24*a* extending along a second plane at a parallel and spaced apart relationship with respect to said first plane;

B) a cone 30 with a peripheral edge portion 32 having cooperative dimensions to the snuggly fit within said depression 24 and further including a step 35 at a predetermined distance from distal end 32*a;*

C) a ring 40 having cooperative dimensions to be received within said channel 22 to coact against said edge portion 32 and said step 35; and D) fastening means 50 for securing said ring 40 to said basket assembly 20 thereby keeping the edge portion 32 of said cone 30 in place.

2. The speaker assembly set forth in claim 1 wherein said step 35 is at a distance away from distal end 32*a* of edge portion 32 that is slightly larger than the depth of depression 24.

3. The speaker assembly set forth in claim 2 wherein said ring is housed within said channel with a small overlap over said depression 24.

* * * * *